US007165345B2

(12) United States Patent
Beaudoin

(10) Patent No.: US 7,165,345 B2
(45) Date of Patent: Jan. 23, 2007

(54) AUTOMATED CONTROL MECHANISM FOR A SNOW BLOWER DISCHARGE CHUTE

(76) Inventor: Gilles Joseph Beaudoin, 196 Mitchell Street, Port Colborne, Ontario (CA) L3K1Y3

( * ) Notice: Subject to any disclaimer, the term of this patent is extended or adjusted under 35 U.S.C. 154(b) by 0 days.

(21) Appl. No.: 10/104,210

(22) Filed: Mar. 25, 2002

(65) Prior Publication Data

US 2003/0177669 A1 Sep. 25, 2003

(51) Int. Cl.
*E01H 5/09* (2006.01)

(52) U.S. Cl. ..... 37/261; 37/247

(58) Field of Classification Search ..... 37/260, 37/257, 246, 244, 243, 249, 261, 262, 265, 37/285; 74/551.5, 554; 180/19.1, 19.2, 180/19.3

See application file for complete search history.

(56) References Cited

U.S. PATENT DOCUMENTS 3,509,977 A * 5/1970 Bacon ..... 193/22
3,726,029 A * 4/1973 Deen et al. ..... 37/261
4,104,812 A * 8/1978 Stribiak, Jr. ..... 37/243
4,205,468 A * 6/1980 Greider ..... 37/260
4,391,052 A * 7/1983 Guy, Jr. ..... 37/236
4,409,748 A * 10/1983 Westimayer ..... 37/261
5,444,927 A * 8/1995 Sosenko ..... 37/260
5,735,064 A * 4/1998 Holl ..... 37/260

* cited by examiner

*Primary Examiner*—Meredith C Petravick

(57) ABSTRACT

The automation mechanism has of three rubber discs, two of which are connected to two swiveling brackets. The brackets are directed by two cables and two cable levers, each one connected to each handlebar. The swivelling brackets consist of two rubber discs that make contact to the center disc at the left side of the shroud. This center disc is connected to the rotating snow auger inside the shroud, which is the driving force for this invention. When one of the rubber discs makes contact with the rotating rubber disc at the center, it rotates a drive chain that is connected to a sprocket near the discharge chute. The sprocket rotates a clutch that rotates a worm gear, and in turn, rotates the discharge chute. Once the discharge chute reaches its maximum rotating limit, the clutch disengages by slipping. The operator can move the chute either right or left by pulling on either the left or right lever on the handlebars, while operating the snow blower at the same time. The auger must be engaged in order for the swivelling discharge chute to work.

7 Claims, 5 Drawing Sheets

AUTOMATED CONTROL MECHANISM FOR A SNOW BLOWER DISCHARGE CHUTE

BACKGROUND OF THE INVENTION

Snow blowers are a common tool used particularly in colder climates. There are many different designs, but few have automated swivelling discharge chutes. Most snow blowers have a crank that must be manually rotated to swivel the chute in the proper direction, making it difficult to operate the snow blower at the same time. Those that do have automated discharge chutes are driven by a separate electric motor, which also requires a battery and a greater magneto. These added parts adds considerable cost and complexity to the construction of the snow blower. Those that are driven by the engine are mechanically complex, expensive to build and demonstrate considerable wear on rapidly rotating parts. Typical automated snow chutes of these types are shown, for example, in the following patents from the United Kingdom, the United States of American and Canada:

U.S. Pat. No. 5,444,927 Mar. 7, 1994 SOSENKO; EP0372150 Jun. 13, 1990 HANYU; U.S. Pat. No. 6,058,629 May 9, 2000 PETERSON; U.S. Pat. No. 4,409,748 Oct. 18, 1983 WESTIMAYER

Although automated discharge chutes have been incorporated into higher-end snow blower designs, there has been a continuing need for a less costly and simpler solution.

SUMMARY OF THE INVENTION (BRIEF DESCRIPTION)

Figure 1:
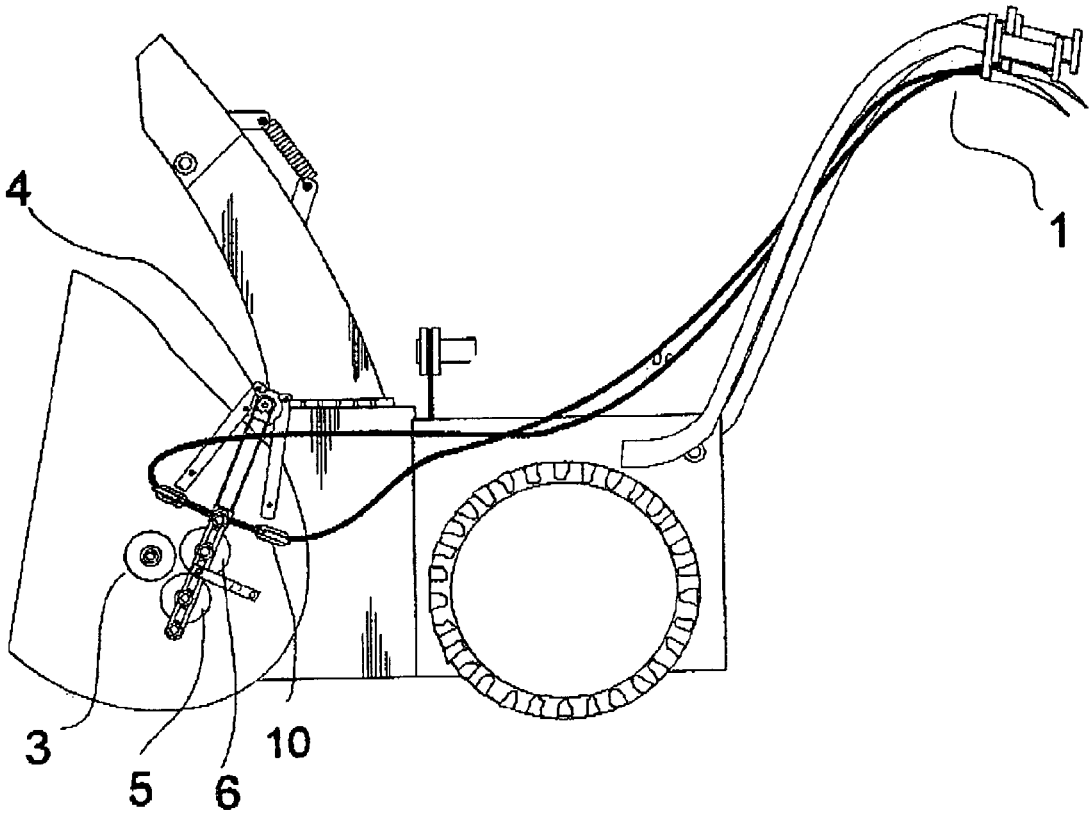

FIG. 1: is a left side view of a snow blower with the automated mechanism attached to the left side of the shroud, auger and shroud assembly.

Figure 2:
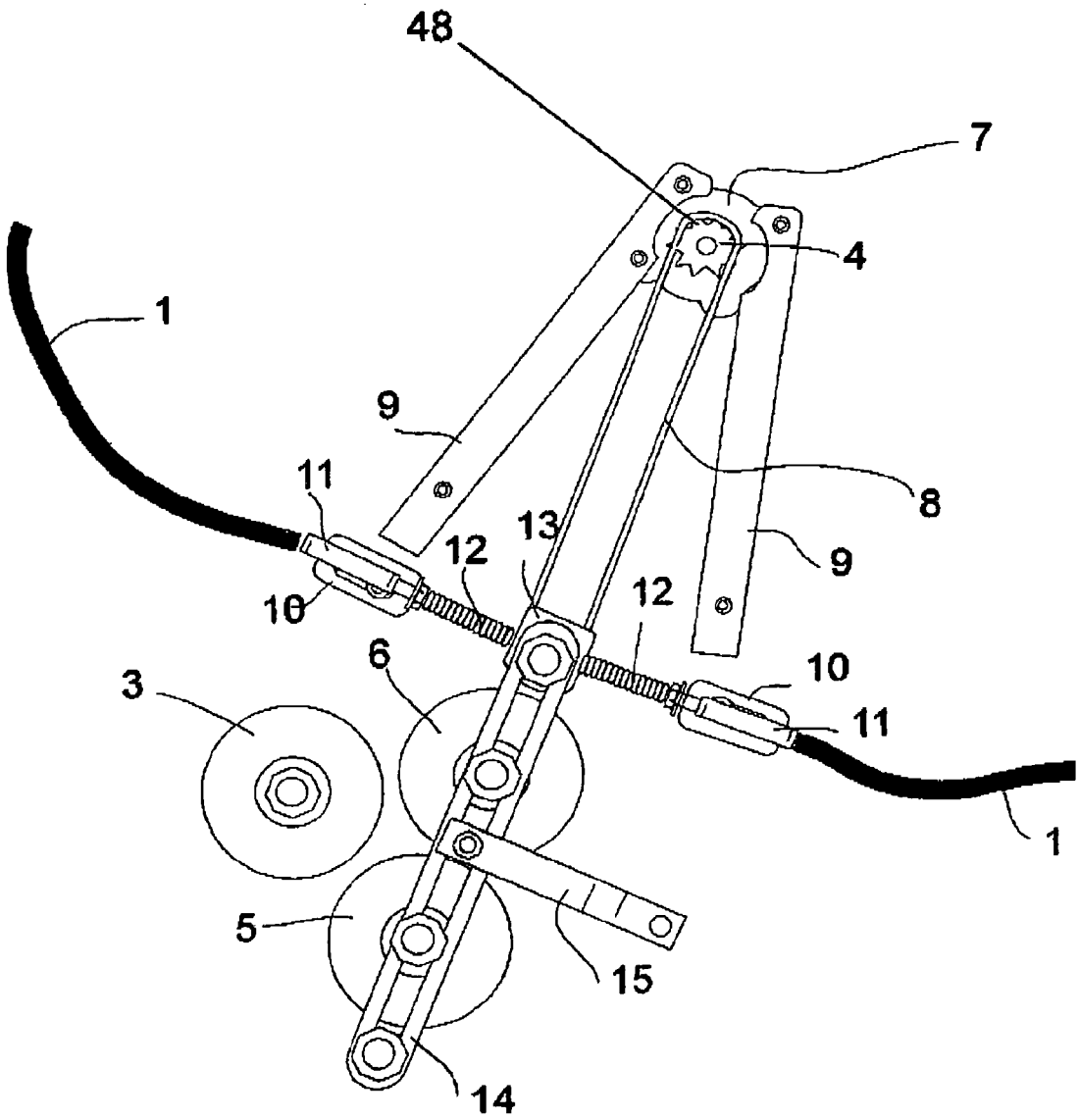

FIG. 2: is a detailed side view of the mechanism in a neutral position, with some parts enlarged for clarity of the illustration.

Figure 3:
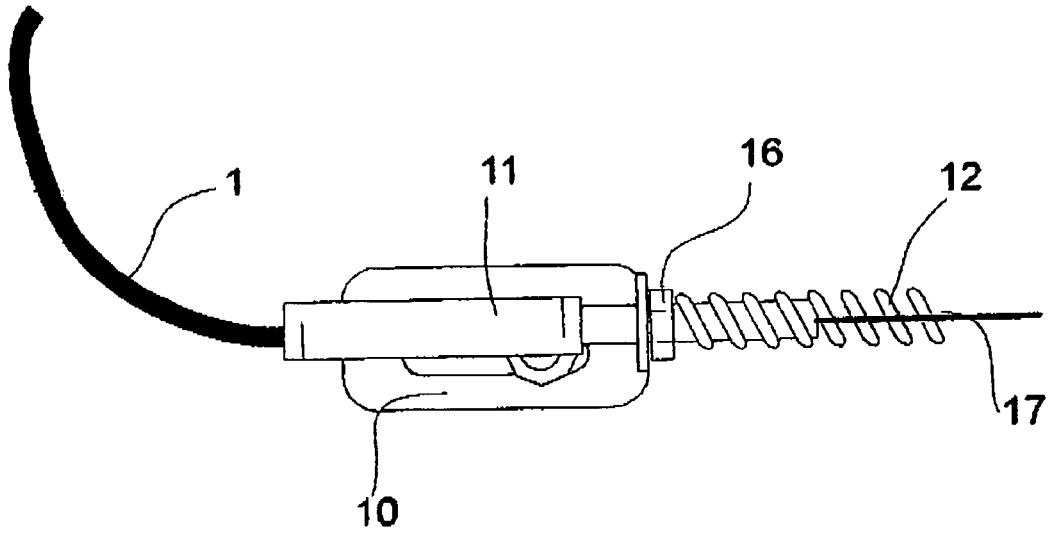

FIG. 3: is a detailed view of a cable adjuster and a tension spring holding the mechanism in neutral.

Figure 4:
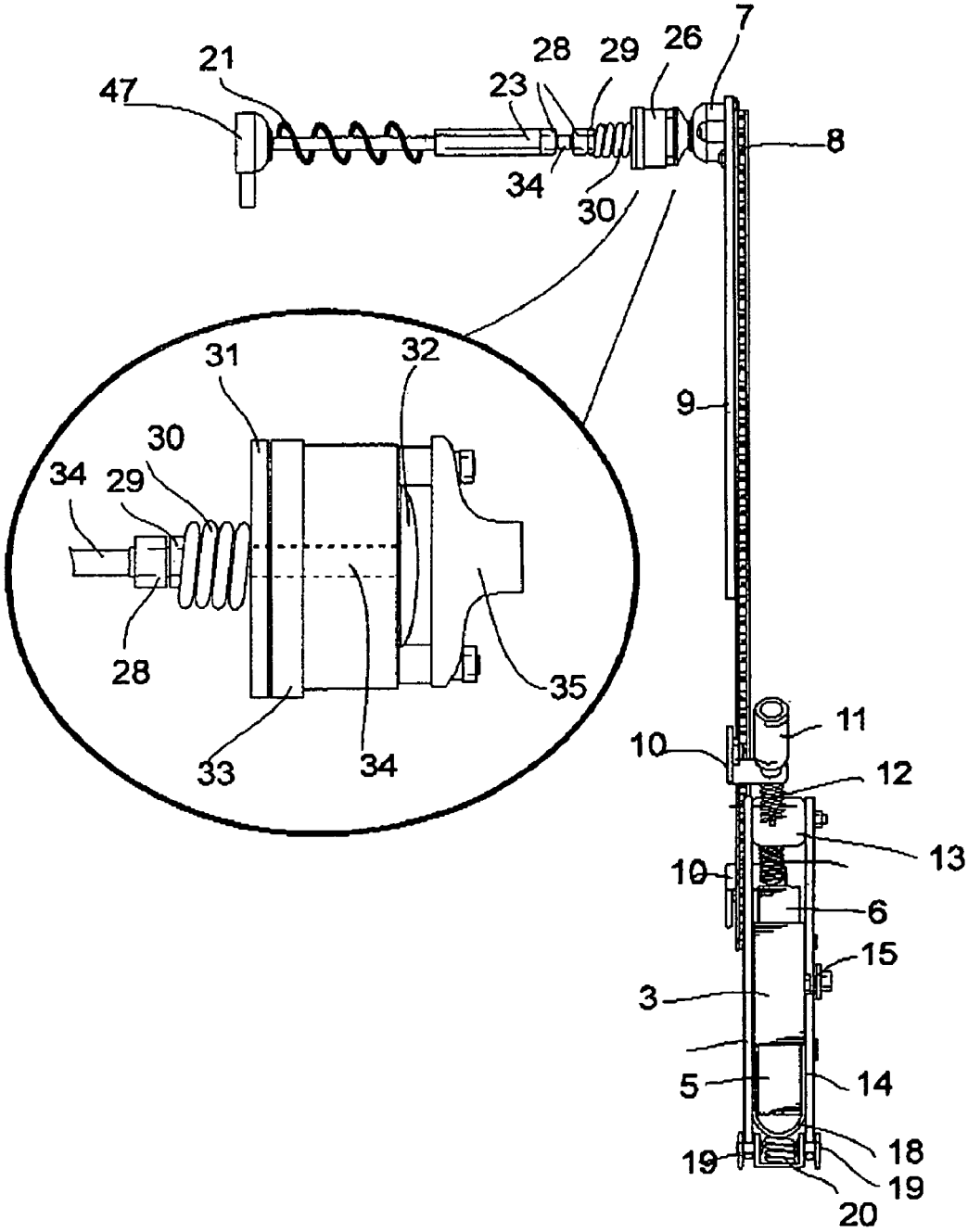

FIG. 4: is a front view of the entire disc mechanism without the cables and snow blower.

Figure 5:
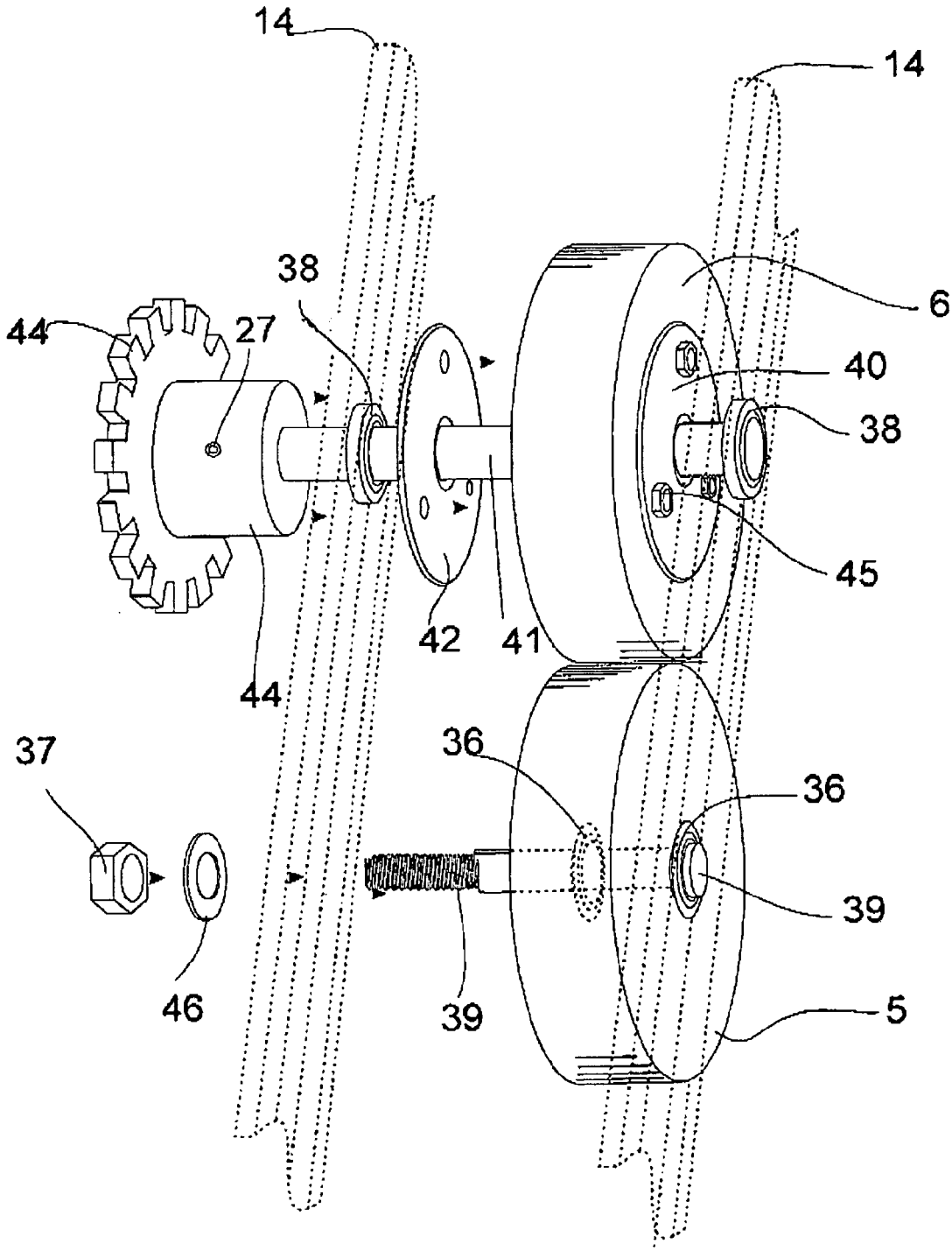

FIG. 5: is a detailed view of the swivelling disc mechanism, including its inner parts.

DESCRIPTION

This invention provides for an automated control mechanism that rotates the swivelling discharge chute in the direction of the user's desire.

DETAILED DESCRIPTION

The automated control mechanism for the swivelling snow discharge chute essentially consists of a rubber disc 3 that drives the chain 8 to rotate the worm gear 21. The rubber disc 3 is bolted to the auger of the snow blower, which is the driving force needed to rotate the snow discharge chute. Discs 5 and 6 are bolted to two swivelling brackets 14 that is beside the disc 3 connected to the auger. The bottom rubber disc 5 contains two bearing 36 press-fit into each side of the disc 5. The rubber disc 5 is mounted to the brackets 14 using a bolt 39 and it is secured in place with a washer 46 and nut 37. The top disc 6 is bolted to a washer 40. Washer 40 is welded onto the shaft 41 and bolted through disc 6 and washer 42 with three bolts 45. The shaft 41 rests inside of two bearings 38, which is press-it into the brackets 14. This provides the easy rotation of the rubber disc 6.

The swivelling brackets 14 are bolted to the shroud, and held in place with retaining bar 15. They swivel by riding on the thread of the bolt. The operator controls the swivelling brackets 14 by pulling the levers that are connected to two cables 1. The cable 1 rests inside of two cable adjusters 11. Inside the cable adjusters 11, the cables' outer casing 1 is cut short about 1 centimeter from the setscrews 16 to allow for enough slack when the other opposing cable 1 is pulled. This slack is required to allow for the swivelling bracket 14 to move in either direction. The cable adjusters 11 are bolted to two mounting brackets 10 using two setscrews 16, which in turn are bolted to the shroud. The cable wires 16 are connected to two cable retainers 13, and are held there by a setscrew. Springs 12 are located at the end of each cable adjuster 11, and are needed to hold the swivelling brackets 14 in the neutral position so that it does not engage the driving disc 3 involuntarily.

When one of the levers is pulled, the cable wire 17 pulls the swivelling brackets 14 to engage one of the rubber discs 5 or 6 to the driving rubber disc 3. Looking at the snow blower from the left side, the right lever pulls the brackets 14 to the left so that the rubber disc at the top 6 engages the driving rubber disc 3, rotating disc 6 clockwise. When the left lever is pulled, the bottom of the brackets 14 engages the bottom rubber disc 5 with the driving rubber disc 3. The bottom disc 5 also rotates clockwise. The bottom disc 5 is mounted on a sliding "U" bracket 18, which allows it to be mated permanently by friction to the top disc 6. The "U" bracket 18 is constantly pushed using a tension spring 20, which is mounted to another "U" bracket 19. As the bottom disc 5 rotates clockwise while engaged to the driving rubber disc 3, it rotates the top disc 6 counter-clockwise.

The top rubber disc 6 is connected to a shaft 41 and shaft 41 is connected to sprocket 44 and held by a setscrew 27. The sprocket 44 drives a chain 8 to another sprocket 48 above the auger shroud. The top sprocket 48 is connected to a shaft 4 and is held onto this shaft 4 by a setscrew. The shaft 4 rests inside a bearing, which is located inside the bearing mount 7 and held in place with two bearing, mount plates 9. The shaft 4 is connected to the clutch 26 through the top of the coupling 35. The clutch 26 is made up of two different metals. Items 26 and 31 are made out of steel, while items 32 and 33 are made out of brass and the brass bushing 33 rests on the shaft 34. The steel washer 31 is welded onto tension spring 30, which in turn, is welded to a nut 29. This nut 29 is the adjustable part of the clutch 26 creating the right amount of tension needed to turn the discharge chute, but allowing the clutch 26 to slip once the discharge chute has reached it maximum turning radius.

The nut 29 is secured in place with another nut 28, retaining the proper adjustment of the tension spring 30. The shaft 34 is connected to worm screw 21 which turns the discharge chute. While looking at the snow blower from the front of the machine, the left side of the worm gear and clutch assembly bearing mount 47 is welded onto the snow blower shroud.

The embodiments of the invention in which an exclusive property or privilege is claimed are defined as follows:

1. A snow blower discharge chute having a control mechanism for rotating the discharge chute, the control mechanism comprising:

a first driven rubber disc;

second and third rubber discs mounted to a swiveling bracket, wherein the second rubber disc is mounted above a pivot point of the swiveling bracket and the third rubber disc is mounted below the pivot point of the swiveling bracket, wherein the third rubber disc drivingly contacts the second rubber disc;

a first sprocket attached to the second rubber disc by a shaft, wherein the first sprocket rotates with the second rubber disc;

a second sprocket attached to the first sprocket by a chain;

a clutch mechanism attached to the second sprocket by and attached to a worm gear, where the clutch mechanism rotates the worm gear, the worm gear attached to the discharge chute, wherein as the worm gear rotates the discharge chute rotates;

a first cable attached to a first control lever of the snow blower and a first side of the swiveling bracket by a first cable adjuster;

a second cable attached to a second control lever of the snow blower and a second side of the swiveling bracket by a second cable adjuster;

wherein pulling on the first cable causes the swiveling bracket to pivot and the second rubber disc to contact the first rubber disc thereby driving the second rubber disc in a first direction and causing the discharge chute to rotate in a first direction; and wherein pulling on the second cable causes the swiveling bracket to pivot and the third rubber disc to contact the first rubber disc thereby driving the third rubber disc, wherein the third rubber disc drives the second rubber disc in a second direct and causes the discharge chute to rotate in a second direction.

2. A snow blower discharge chute as in claim 1, wherein an outer casing is provided on both the first and second cable between the cable adjusters and the levers.

3. A snow blower discharge chute as in claim 1, wherein a first cable retainer connects the first cable to the first side of the swiveling bracket and a second cable retainer connects the second cable to the second side of the swiveling bracket; and wherein a first spring is provided between the first cable retainer and the first cable adjuster and a second spring is provided between the second cable retainer and the second cable adjuster so as to maintain the swiveling bracket in a neutral position when neither cable is being pulled.

4. A snow blower discharge chute as in claim 1, wherein the third rubber disc is mounted on the swiveling bracket by a sliding U-bracket so that a third spring urges the third rubber disc to contact the second rubber disc.

5. A snow blower discharge chute as in claim 1, wherein the snow blower has a rotating auger and the first disc is driven by the rotating auger.

6. A snow blower discharge chute as in claim 1, wherein the clutch has a brass bushing and a steel component and wherein the brass bushing slips against the steel component when the discharge chute reaches its maximum rotation.

7. A snow blower discharge chute as in claim 1, wherein the clutch has a tension spring.

* * * * *